United States Patent [19]

Bonham

[11] 3,977,335

[45] Aug. 31, 1976

[54] AUTOMATED HAIR IMPLANTATION SYSTEM

[76] Inventor: Albert W. Bonham, 3594 South - 3610 East, Salt Lake City, Utah 84109

[22] Filed: Sept. 25, 1974

[21] Appl. No.: 509,096

[52] U.S. Cl. ..... 112/79 R; 132/5

[51] Int. Cl.[2] ..... D05C 15/02

[58] Field of Search ..... 132/5, 56; 112/79 R, 112/410, 79.5; 156/72, 435

[56] References Cited

UNITED STATES PATENTS

| | | | |
|---|---|---|---|
| 1,483,713 | 2/1924 | Bourgeois | 112/79.5 |
| 3,513,860 | 5/1970 | Kost | 132/5 |
| 3,580,761 | 5/1971 | Boultinghouse | 156/72 |
| 3,595,186 | 7/1971 | Shorrock et al. | 112/79 R |
| 3,756,879 | 9/1973 | Bonham | 132/5 X |

*Primary Examiner*—Werner H. Schroeder
*Assistant Examiner*—Peter Nerbun
*Attorney, Agent, or Firm*—Criddle, Thorpe & Western

[57] ABSTRACT

An automated system for implanting hair in a scalp base includes a hollow needle, a linkage arrangement for holding and moving the needle along an arc-like path between a first and second position, and apparatus for holding and positioning a bundle of hair in the path traversed by the needle so that the needle contacts the bundle hair ends to receive into the hollow at least one hair as the needle is moved from the first position to the second position. A shoe element is disposed at the second position for supporting the scalp base so that as the needle is moved to the second position, the needle penetrates the scalp base placed on the shoe element to thereby implant a hair carried by the needle. Also included is a projector for projecting a narrow beam of light to the shoe element to mark a spot through which the needle will pass.

29 Claims, 7 Drawing Figures

AUTOMATED HAIR IMPLANTATION SYSTEM

BACKGROUND OF THE INVENTION

This invention relates to an automated system for seizing and implanting hair in a scalp base.

The most commonly used prior art method of hairpiece construction involves inserting hairs through a mesh backing material and then tying the hairs to hold them in place. Because of the large amount of hand labor required in this method, the difficulties in properly caring for hairpieces made in this fashion, and the obvious difference in texture and coloring between the wearers skin and the mesh backing material used for the hairpiece, other more efficient methods for producing more natural looking hairpieces have been sought. One such method, disclosed in U.S. Pat. No. 3,756,879, involves the use of a hand held, mechanically driven punch to implant hairs into a rubbery scalp base such as silicone. This method reduces the amount of hand labor required to make a hairpiece and also yields a hairpiece which is more natural looking. However, with this method, it is difficult to rapidly and efficiently implant single hairs which, for repair of hairpieces, is a desired objective.

SUMMARY OF THE INVENTION

It is an object of the present invention to provide a new and improved automated system for implanting hair in an artificial scalp base.

It is also an object of the present invention to provide an automated hair implantation system which may accurately and rapidly implant a single hair into a scalp base.

It is a further object of the present invention to provide an automated hair implantation system which is simple and inexpensive to construct.

The above and other objects and advantages of the present invention are realized in an illustrative embodiment which includes apparatus for holding a plurality of hairs, a needle hollowed out at least at one end thereof, and apparatus for moving the needle so that it contacts the hair ends and receives into the hollowed out end at least one hair. The apparatus for moving the needle then causes the needle to penetrate a scalp base and thereby implant the hair carried by the needle. By properly positioning the scalp base, individual hairs may be accurately and efficiently implanted therein.

BRIEF DESCRIPTION OF THE DRAWINGS

The above and other objects, features and advantages of the present invention will become more apparent from a consideration of the following detailed description presented in connection with the accompanying drawings in which.

DETAILED DESCRIPTION

Figure 1:
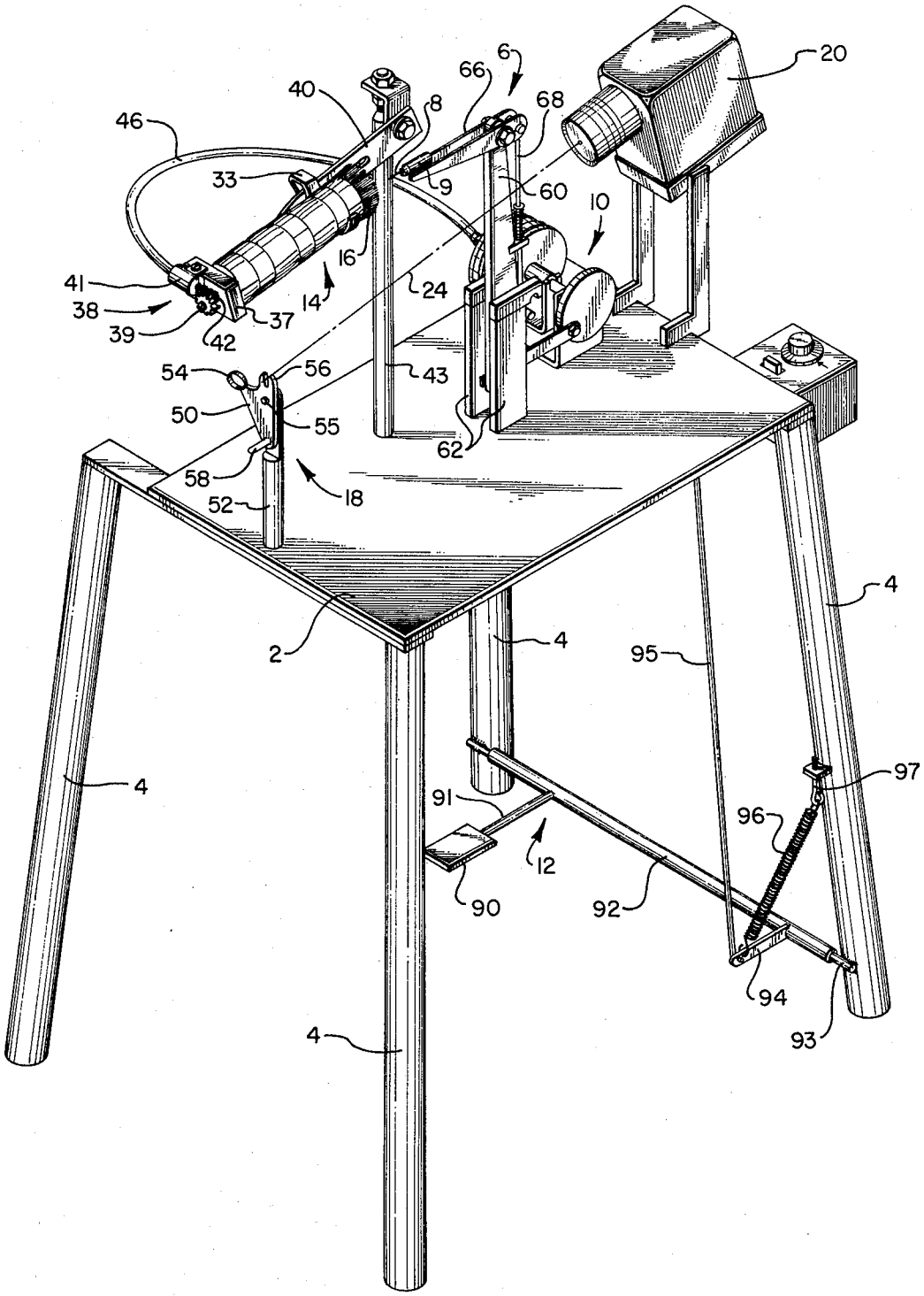
FIG. 1 shows a perspective view of an automated hair implantation system made in accordance with the principles of the present invention.

The system of FIG. 1 includes a frame or platform 2, supported by four legs 4, for carrying most of the elements of the system. These elements include a needle-carrying linkage 6 for holding and moving a hollow needle 8 along a predetermined path. The end of the needle 8 extending from the linkage 6 advantageously is beveled as best seen in a magnified view of the needle in FIG. 3A. The beveled end exposes the hollow which extends within the shank of the needle. The needle-carrying linkage 6 is driven by a drive apparatus 10 controllable by a foot operated control mechanism 12 (FIG. 1).

Also mounted on the platform 2 is apparatus 14 for holding a bundle of hair 16. The apparatus 14 positions the hair bundle so that the needle 8 may contact the hair ends as the needle is moved by the linkage 6. A shoe 18 is mounted on the platform 2 to support a scalp base into which hair is to be implanted. The shoe 18 is positioned on the platform 2 at the end of the path traversed by the needle 8 so that a scalp base placed on the shoe 18 will be penetrated by the needle. This is best seen in FIG. 3B.

To guide the user in positioning the scalp base on the shoe 18 so that the user will know where, in the scalp base, the needle 8 will penetrate, a projector 20 is provided to project a narrow beam of light to a location through which the needle 8 will pass. A spot of light will thus show on a scalp base positioned on the shoe 18 to mark the location at which the needle will penetrate and implant a hair. Before describing in greater detail each of the elements of the system, a general description of the operation of the system will be given.

Figure 3A:
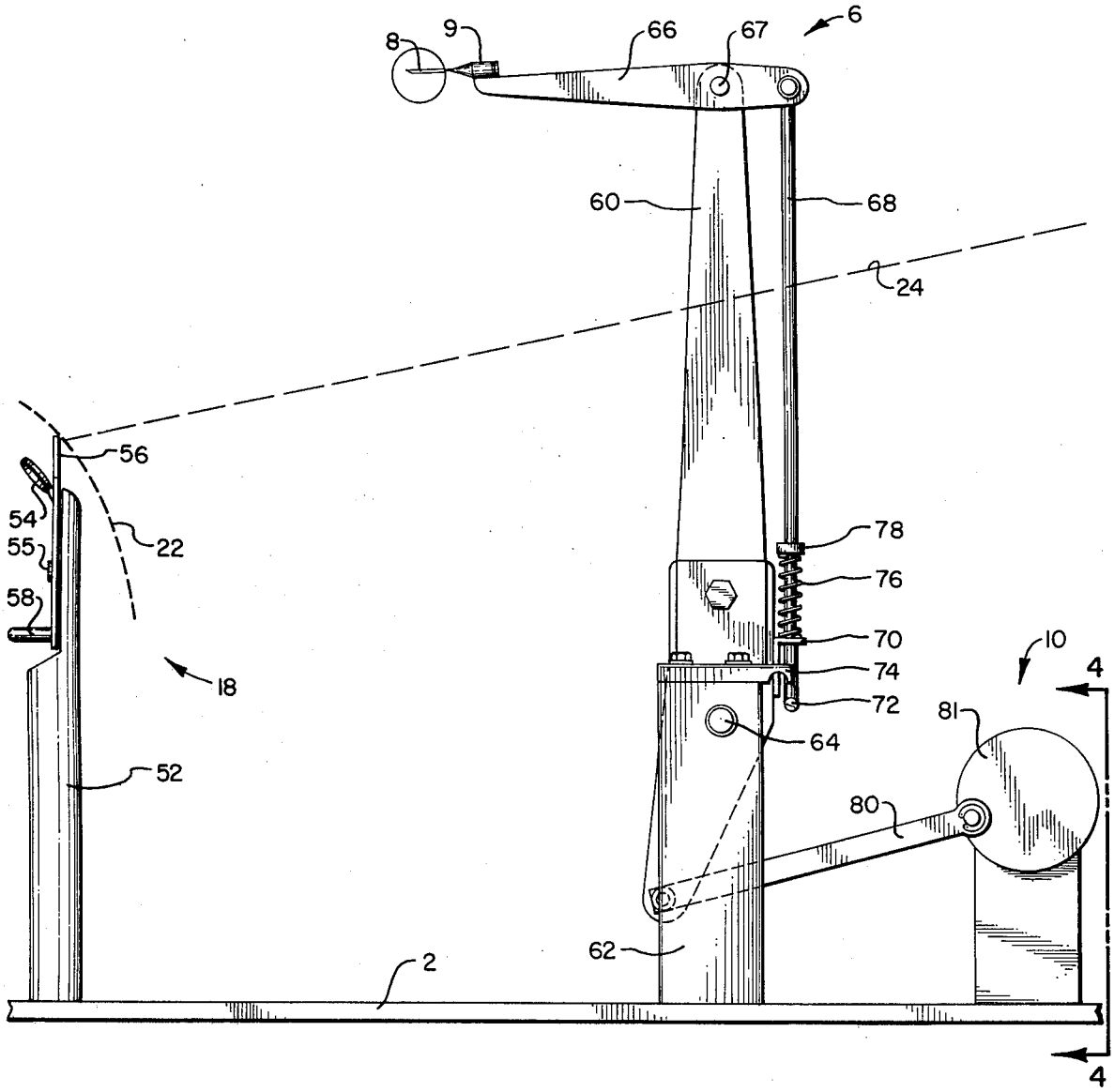
FIGS. 3A and 3B are side elevational views of the needle-carrying linkage of the system of FIG. 1.
Figure 3B:
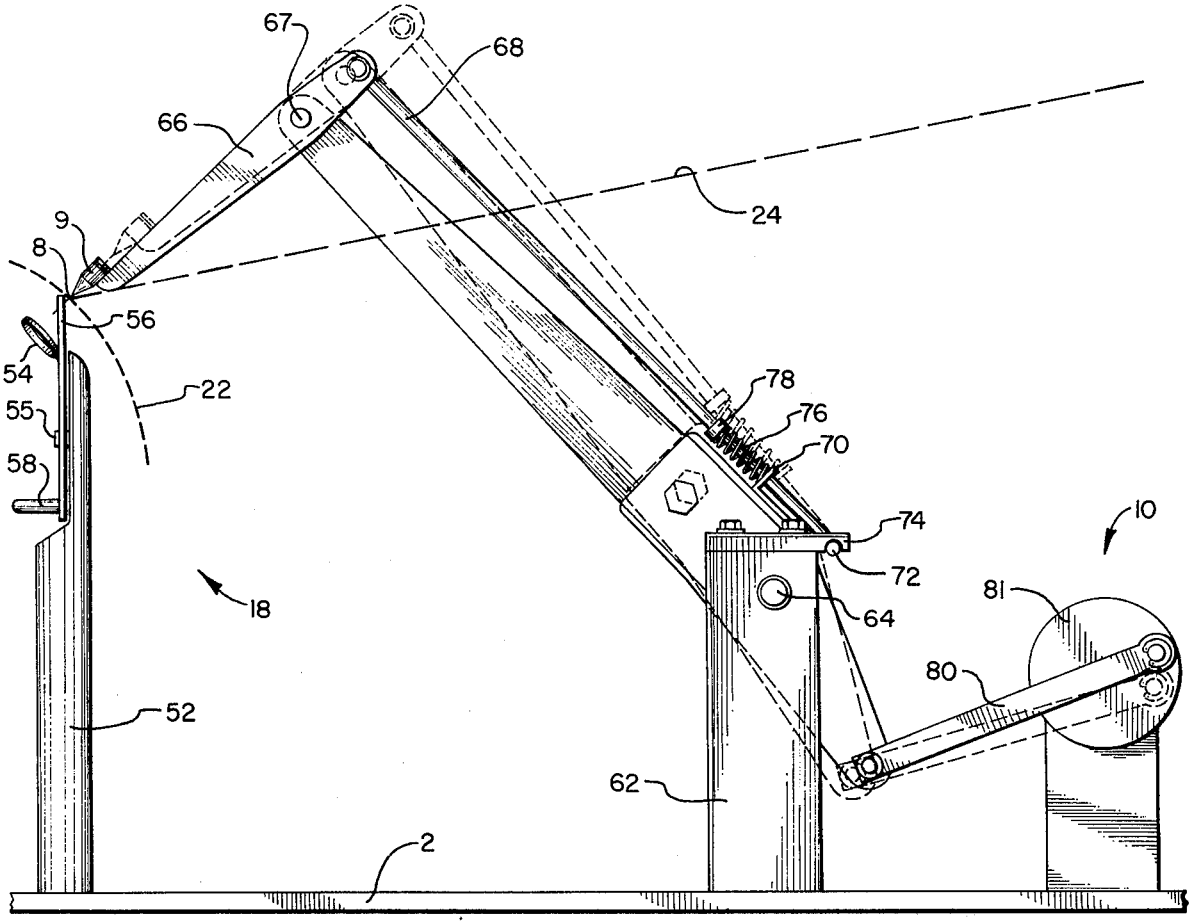

Referring to composite FIG. 3, the scalp base 22 (shown by dotted line) into which hair is to be implanted is positioned over the shoe 18 as generally shown in the drawing. The scalp base advantageously may be made of silicone rubber or other rubbery-like material. The scalp base 22 is positioned so that the beam of light 24 falls on the spot of the scalp base where the hair is to be implanted. When the scalp base 22 is properly positioned, the drive mechanism 10 is actuated to cause the linkage 6 to pivot from a first position (shown in FIG. 3A) toward the scalp base 22 (shown by the phantom drawings of the linkage 6 in FIG. 3B) to a second position. The linkage 6 carries the needle along an arc-like path into contact with the ends of the hair 16 (FIG. 1). The movement of the needle into contact with the hair ends causes one of the hairs to be forced into the hollow of the needle and then as the needle is carried through the hair bundle 16, the hair received into the hollow of the needle is pulled from the bundle and carried downwardly toward the scalp base 22. The linkage 6 carries the needle through the arc-like path until the needle is fairly near the scalp base 22 at which time the linkage 6 causes the needle to move generally in a linear path to penetrate the scalp base. The hair is carried by the needle into the scalp base 22 where it remains after the needle is pulled out of the scalp base. The linkage 6 returns to the upright position where it is ready to again be moved so that the needle contacts and seizes another hair for implanting in the scalp base, In this manner, individual hairs may be seized by the end of the needle and accurately and efficiently implanted in a scalp base.

Figure 2:
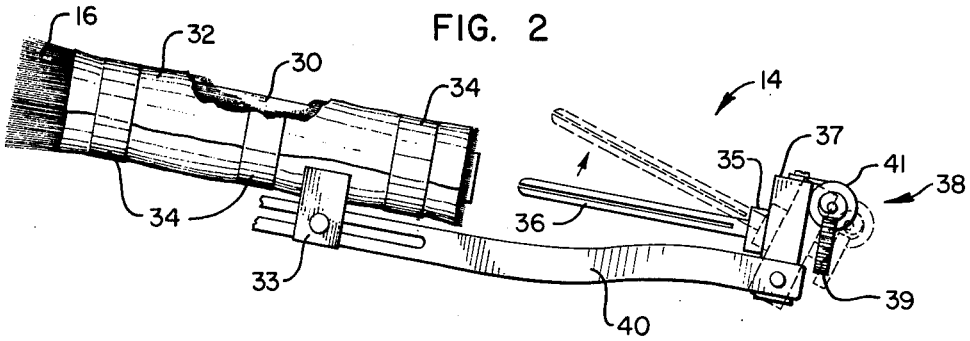
FIG. 2 is a side elevational view of the hair positioning apparatus of the system of FIG. 1.

The apparatus 14 for holding the bundle of hair 16, as best seen in FIG. 2, includes a generally cylindrical spool 30 (shown by dotted lines) which has a bore extending axially therethrough. The hair 16 is placed on the exterior surface of the spool 30 so that the hair ends extend beyond one end of the spool and terminate substantially in a flat plane. The hair is held in place on the spool by a piece of cloth or paper 32 wrapped about the hair and the cloth or paper 32 is, in turn, held in place by strips of adhesive tape 34.

The hair holding apparatus also includes a split-pin spindle 36 on which may be placed the spool 30. The spindle 36 is rotatably mounted in a yoke 37 which, in turn, is pivotally mounted on a bar 40. A spacer 35 is mounted on the spindle 36 to rotate therewith. The bar 40 is carried by an upright beam 43 (FIG. 1) mounted on the platform 2.

When the spool 30 is slipped over the spindle 36, the walls of the spindle bore intimately contact the surface of the spindle 36 compressing the spindle to enable the spindle to hold the spool 30 in place. The spool 30 would be placed on the spindle 36 when the spindle and yoke 37 were pivoted upwardly as shown by the dotted line in FIG. 2 and, after the spool 30 were placed on the spindle, the spindle and yoke would be pivoted downwardly until the covering 32 contacted and rested upon a spool and hair support 33. The support 33 is slideably mounted on the bar 40 and is provided to properly position the hair 16 in the pathway traversed by the needle 8.

A worm gear assembly 38 is mounted on the back of the yoke 37 for causing the spindle to rotate. A worm wheel 39 is mounted on the end of the spindle 36 extending through the yoke 37 so that when the wheel 39 is rotated, th spindle 36 is similarly rotated. As best seen in FIG. 1, a worm shaft 42 for driving the worm wheel 39, is journaled in a collar bearing 41 mounted on the yoke 37. The worm shaft 42 is coupled to a flexible shaft 46 which, in turn, is connected to the drive mechanism 10. When the flexible coupling 46 is rotated causing the worm shaft 42 to rotate, the worm wheel 39 is rotated causing the spindle 36 and spool 30 mounted thereon to rotate. The spool 30 thus presents a different portion of the hair bundle to the needle 8 each time the needle is caused to move, seize and implant a hair. By rotating the hair bundle 16, as the needle is carried back from the shoe 18 toward its starting position, it passes through a portion of the hair bundle to, in effect, comb and straighten the hair. In other words, passage of the needle through the hair bundle 16 on its return from implanting a hair, helps prepare the hair bundle for the next seizure of a hair by the needle.

The shoe 18 on which a scalp base 22 is placed includes a turret 50 rotatably mounted on an upright post 52 which, in turn, is mounted on the platform 2. Formed in the turret 50 are a ring 54 and a slot defining portion 56. The turret 50 is mounted to rotate about a pin 55 carried by the upright post 52 to position either the slot of the slot defining portion 56 or the center of the ring 54 at the end of the pathway traversed by the needle 8. When the slot is positioned in the pathway, then, as best seen in FIG. 3B, the needle 8 will be moved to a position where it extends within the slot. Similarly, when the ring 54 is positioned in the pathway traversed by the needle 8, the needle will be moved to a position where it extends within the ring.

It has been found that the slot is more suitable as a support for the scalp base when implanting along a hair part and that the ring is more suitable when implanting around the crown of a hairpiece. The slot of the slot defining portion 56, being narrower than the diameter of the ring 54, provides a more rigid support for the scalp base. However, since hair implanted around the crown of the hairpiece is generally quite thick, the hair roots on the underneath surface of the scalp base begin to bunch up at the crown making it difficult to properly position the hairpiece on the slot defining portion 56. That is, the bunched hair may not be fitted in the slot of the slot defining portion 56 making it difficult to properly position the scalp base. By providing the ring 54 having a fairly large opening, the bunched hair may be readily inserted within the ring thereby facilitating freer movement and positioning of the scalp base. Of course, other scalp base support configurations could be provided on the turret 50 as desired by the user.

The needle-carrying linkage 6, as indicated earlier, carries the needle 8 from a first position along an arc-like path to seize a hair from the hair bundle 16 and then carries the needle along a generally linear path to a second position into the scalp base 22. This is accomplished by a novel parallel-arm linkage arrangement (best shown in composite FIG. 3) consisting of an upright support arm 60 mounted between a pair of upright braces 62 (FIG. 1) which, in turn, are mounted on the platform 2. The support arm 60 is mounted to pivot about a pin 64, extending between the two upright braces 62, from an upright position downwardly toward the shoe 18. A two-piece needle-carrying arm 66 is mounted by a pin 67 at the upper end of the support arm 60 generally perpendicular thereto. The needle 8 is mounted to extend from a cylindrical holder 9 mounted at one end of the arm 66. The needle 8 extends generally toward the hair bundle 16 and shoe 18. The other end of the arm 66 is attached to one end of a third arm 68 which is carried by the support arm 60 in a generally parallel relationship therewith.

The arm 68 extends through an opening in a bracket 70 attached to the support arm 60. The bottom end of the arm 68 is formed into a T-member 72, with the horizontal portion of the T-member positioned underneath two stop elements 74 (best seen in FIG. 4B) extending horizontally from the top of the two braces 62. The underneath surface of each of the two stop elements 74 is formed into a semicircular groove positioned above a corresponding horizontal portion of the T-member 72 of the arm 68. A coil spring 76 is coiled about the arm 68 between the bracket 70 and a collar 78 formed about the arm 68. The bottom end of the support arm 60 is connected to a drive rod 80 of the drive mechanism 10. The operation of the linkage 6 will now be described.

When the drive rod 80 is drawn away from the braces 62, the support arm 60 is caused to pivot downwardly toward the shoe 18 to carry the arm 66 and arm 68. As the support arm 60 moves downwardly, the T-member 72 of the arm 68 moves upwardly to engage the semicircular grooves in the stop elements 74. As the support arm 60 continues to pivot downwardly, the T-member 72 and thus the arm 68 is prevented from further upward movement so that the arm 68 restrains the arm 66 causing it to pivot about the pin 67 in such a manner that the arm 66 and thus needle 8 are caused to move in a generally linear path. This is illustrated by the showing of the linkage 6 in FIG. 3B. In other words, when the T-member 72 of the arm 68 contacts the stop elements 74, further movement downwardly of the support arm 60 causes the arm 66 to pivot relative to the support arm 60 resulting in a generally linear movement of the needle 8. The utilization of general parallel linkage arrangements to accomplish linear movement is well known.

As the drive rod 80 begins to move back toward the braces 62 to pivot the support arm 60 toward its upright position, the spring 76 urges the arm 68 to slide upwardly relative to the support arm 60 to thereby cause the arm 66 to pivot toward its initial position. The needle 8 is thus caused to withdraw from the scalp base 22 along a generally linear pathway until the T-member 72 of the arm 68 disengages the stop elements 74. From that point, as the support arm 60 moves back to the upright position, the arm 66 and needle 8 traverse a generally arc-like pathway. In the manner described, the linkage 6 provides for moving the needle first through an arc-like path and then through a generally linear path to implant the hair into a scalp base.

It has been found advantageous to cause the needle to approach the hair ends from a direction above the direction in which the hair ends point. Thus, moving the needle along an arc-like pathway downwardly toward the hair ends facilitates seizure of a hair in the hollow needle for subsequent implantation of the hair. However, once the hair is seized, it is desirable that the needle penetrate the scalp base along a pathway generally co-linear with the needle so that the needle may enter the scalp base and make as small a hole as possible. It can be visualized that if the needle were to enter the scalp base along a pathway forming an angle with the needle, then the scalp base might tend to tear as the needle enters.

The drive mechanism 10 for causing the needle-carrying linkage to move is actuatable by a foot control 12 comprising a pedal 90 supported by a bar 91 extending from a sleeve 92 (FIG. 1). Sleeve 92 is fitted about a bar 93 extending between a pair of legs 4. A finger 94 extends from the sleeve 92 with the end of the finger 94 being coupled to the lower end of a rod 95. When the foot pedal 90 is moved downwardly causing the sleeve 92 to rotate and move the rod 95 downwardly, the drive mechanism 10 is actuated to cause the needle-carrying linkage 6 to commence a reciprocating movement between the above-described first and second positions. When the foot pedal 90 is released, a spring 96 attached between the end of the finger 94 and a hook screw 97 affixed to a leg 4 causes the sleeve 92 to rotate and return the foot pedal 90 and the rod 95 to their initial positions. It should be understood that a variety of arrangements could be employed to actuate the drive mechanism 10 and that the described arrangement is only illustrative of such arrangements.

Figure 4A:
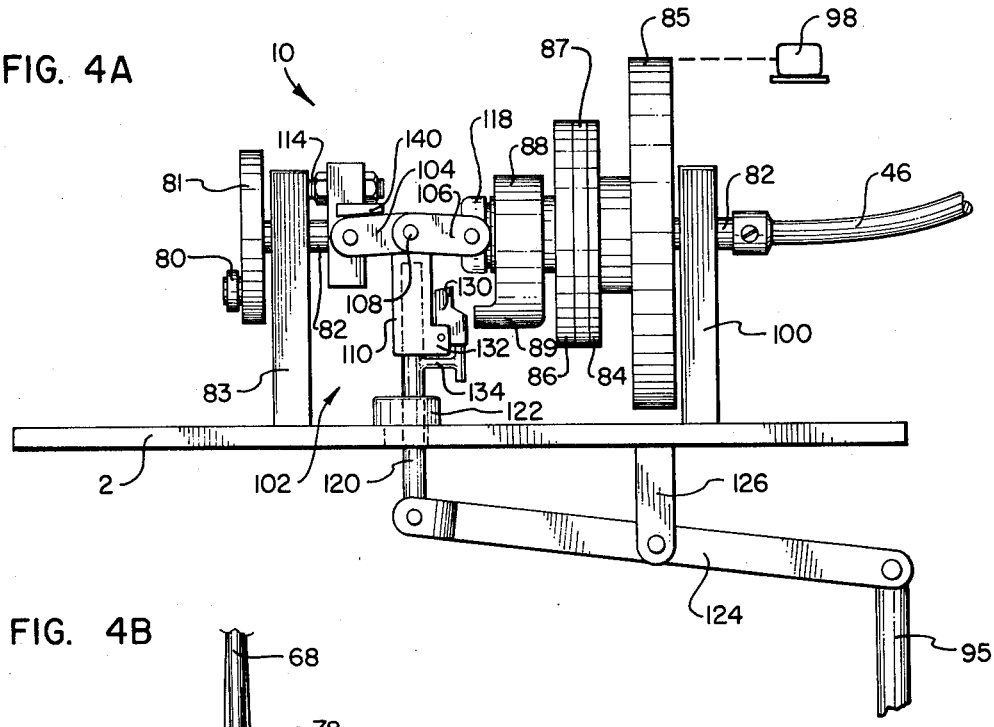
FIGS. 4A and 4B are back elevational views of the drive mechanism for driving the needle-carrying linkage of the system of FIG. 1.
Figure 4B:
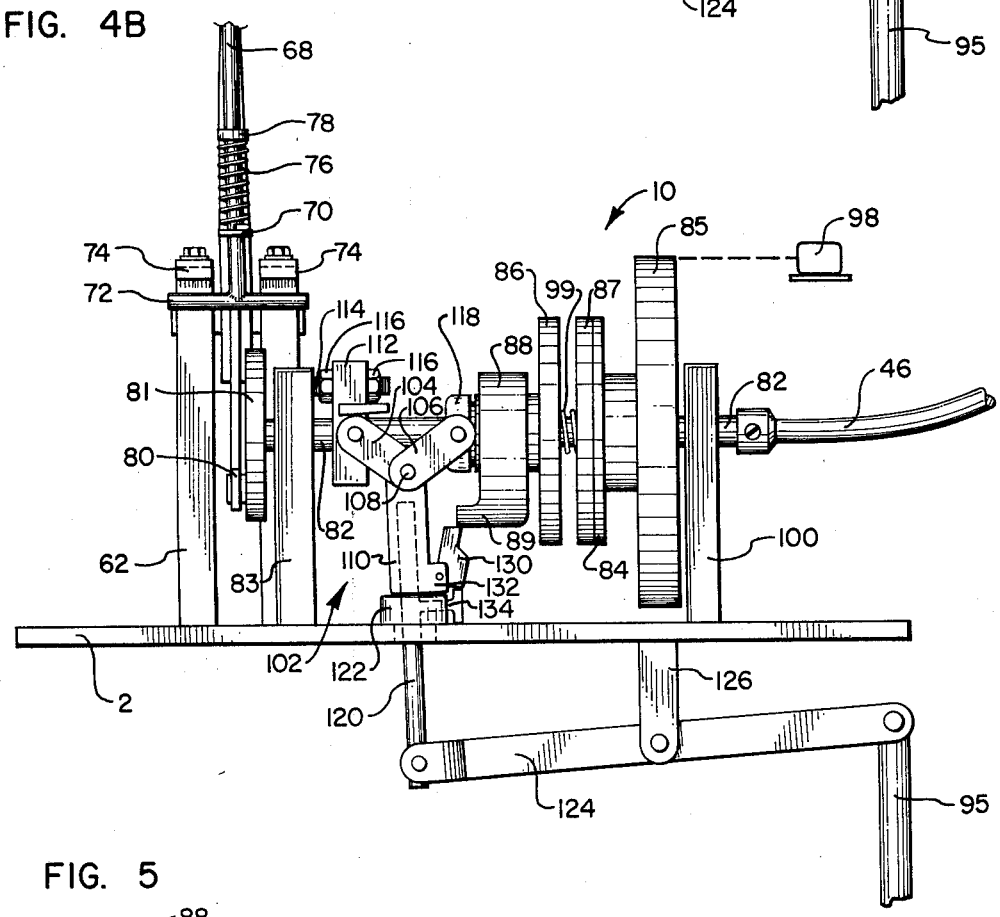

The drive mechanism 10 is shown in an unactuated condition in FIG. 4B and in an actuated condition in FIG. 4A. The drive mechanis· includes a drive disc 81 mounted on a shaft 82 journaled in a bearing of a brace 83. Coupled to one side of the drive disc 81 near the edge thereof is the drive rod 80, best shown in composite FIG. 3, such that when the drive disc 81 is rotated, the drive rod 80 reciprocates thereby causing the needle-carrying linkage to move.

Figure 5:
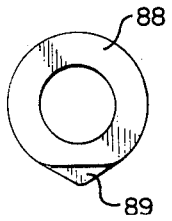
FIG. 5 is a front view of the cam of FIGS. 4A and 4B.

The drive mechanism 10 also includes a friction clutch arrangement having a friction disc 84 rotatably mounted on a pulley 85 which is driven by a motor represented schematically at 98. The friction clutch also includes a second friction disc 86 slidably mounted on the shaft 82 so that when the disc 86 is moved to engage the disc 84, the disc 86 is caused to rotate and thereby rotate the shaft 82. In other words, the disc 86 is mounted to slide longitudinally on the shaft 82, but not to rotate thereon. The friction disc 84 illustratively includes a surface cover 87 composed of a material which wears well and yet which grips metallic surfaces, e.g., urethene. A cam 88 is coupled to the disc 86 to rotate therewith when the disc is rotated and is slidably mounted on the shaft 82. The cam 88 includes a lobe 89, best seen in FIG. 5, the function of which will be discussed momentarily.

The shaft 82 extends from the drive disc 81 through the brace 83, in which it is journaled, and through the cam 88 and disc 86. The shaft 82 also extends through the disc 84 and pulley 85 and through a brace 100 in which the shaft 82 is journaled. The shaft 82 is thus supported and journaled in braces 83 and 100 and the disc 86 and roller 88 are slidably mounted on the shaft 82 to rotate therewith. The disc 84 and pulley 85 are rotatably mounted on shaft 82 and supported by ball bearings, for example. Thus, the disc 84 and pulley 85 rotate freely about the shaft 82. The end of the shaft 82 extends through the brace 100 and is coupled to a flexible shaft 46.

The friction disc 86 is movable between a noncontact position, shown in FIG. 4B, in which the disc is out of contact with the disc 84, and a contact position, shown in FIG. 4A, in which the disc 86 is in frictional engagement with the disc 84. When the disc 86 is in frictional engagement with the disc 84, and the disc 84 is being rotated by the motor 98, then the disc 86 is caused to rotate thereby causing the shaft 82 to rotate and drive the drive disc 81 and the flexible shaft 46.

The disc 86 is moved between the contact and noncontact positions by an assembly 102 consisting of a pair of jointed radiating arms 104 and 106, both pivotally mounted by a pin 108 to support element 110. The arm 104 is also pivotally mounted to a brace element 112 held by a screw 114 extending from the brace 83. The brace element 112 is rigidly secured on the screw 114 by nuts 116. The arm 106 is also pivotally attached to a bushing 118 circumscribing and carried by the shaft 82. The bushing 118 contacts the roller 88 (for example, by way of a thrust bearing) so that when the bushing is moved toward the disc 84, the cam 88 and disc 86 are similarly moved. When the bushing 118 is moved away from the disc 84, a spring 99 coiled about the shaft 82 between discs 84 and 86 forces the cam 88 and disc 86 away from the disc 84.

The support element 110 has a bore therein for allowing an actuator arm 120 to fit thereinto. The actuator arm 120 extends through an opening in the platform 2 and through an opening in a spacer 122 into the bore of the support element 110. The bottom end of the actuator arm 120 is attached to a lever arm 124 which is pivotally supported by an arm 126 extending from the bottom surface of the platform 2. The other end of the lever arm 124 is pivotally attached to the upper end of the rod 95.

A contact member 130 is pivotally mounted on an extension 132 of the support element 110 to pivot toward or away from the support element 110 as shown in FIGS. 4B and 4A. A finger 134 extends laterally from the actuating arm 120 to a point below the contact member 130 so that when the actuator arm 120 is moved upwardly, the finger 134 contacts the bottom edge of the contact member 130 causing the upper portion of the member to move toward and engage the outer wall of the support element 110 as shown in FIG.

4A. The operation of the friction clutch will now be described.

Assume that the clutch is in the disengaged condition as shown in FIG. 4B. To actuate the clutch, the pedal 90 (FIG. 1) is depressed causing the lever arm 124 to move the actuator arm 120 upwardly. When this occurs, the finger 134 contacts the lower edge of the contact member 130 causing its upper portion to move toward and engage the support element 110 and prevent further pivoting of the contact member 130. As the actuator arm 120 continues upwardly, it carries the support element 110 to cause the radiating arms 104 and 106 to expand toward the position shown in FIG. 4A. Ultimately, the radiating arms 104 and 106 will be moved past a point of equilibrium to a point where the arms will exhibit a snap action causing the arm 104 to engage a stop 140 and lock the clutch in the actuated condition. In this condition, the disc 86 is in contact with the disc 84 so that the disc 86, shaft 82 and cam 88 are caused to rotate. The needle-carrying linkage 6 is thus caused to move as previously described.

When the pedal 90 is released (FIG. 1), the spring 96 forces the rod 95 upwardly and thus the actuator arm 120 (composite FIG. 4) downwardly. Since the radiating arms 104 and 106 have been locked off center, they will remain in that condition for a time after the actuator arm 120 is moved downwardly. When the actuator arm 120 is moved downwardly, the finger 134 also moves downwardly allowing the upper portion of the contact member 130 to pivot away from the support element 110. This places the upper edge of the contact member 130 in the path of movement of the lobe 89 of the cam 88. Thus, the cam 88 will rotate and cause the lobe 89 to contact the contact member 130 forcing the contact member and thus the support member 110 downwardly to unlock the radiating arms 104 and 106 allowing the spring 99 to cause the friction disc 86 to disengage from the friction disc 84. The support member 110 drops down until it rests on the spacer 122 as shown in FIG. 4B. In this manner, disengagement of the friction discs 86 and 84 occurs at the same point in the revolution of the discs and the drive wheel 81 and also at the same point in the travel of the needle-carrying linkage 6. Specifically, the lobe 89 of the cam 88 is positioned so that the lobe will contact the contact member 130 to cause disengagement just as the needle-carrying linkage 6 is returning to its upright position. Thus the needle-carrying linkage 6 will always stop in its upright position ready for seizure and implantation of a hair upon subsequent actuation of the drive mechanism 10.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. Apparatus for implanting hair in a scalp base comprising means for holding a bundle of hairs, a needle hollowed out at least at one end thereof, and means for moving the needle generally in a first direction toward the hair ends to contact the hair ends and receive into the hollowed out end at least one hair, and then generally in a second direction different from the first direction as the needle penetrates the scalp base to implant therein the hair carried by the needle.

2. Apparatus as in claim 1 wherein said holding means includes means for positioning the bundle of hairs so that the hair ends to be contacted by the needle terminates substantially in a plane.

3. Apparatus for implanting hair in a scalp base comprising means for holding a bundle of hairs, a needle hollowed out at least at one end thereof, and means for moving the needle so that it contacts the hair ends and receives into the hollowed out end at least one hair, and then penetrates the scalp base to implant therein the hair carried by the needle, wherein said holding means includes a generally cylindrical spool, means for securing the hair on the exterior surface of the spool so that the hair extends beyond one end of the spool, a spindle on which the spool may be mounted, and means for causing the spindle to rotate to thereby cause the spool mounted thereon to rotate.

4. Apparatus as in claim 3 wherein the spool has a bore extending therethrough, and wherein the spindle comprises a split pin insertable in the bore of the spool and adapted to contact the walls of the bore to hold the spool in place.

5. Apparatus as in claim 4 wherein said spindle is disposed to pivot so that the hair ends of hair secured on the spool mounted on the spindle may be moved into the path traversed by the needle or out of the path traversed by the needle.

6. Apparatus as in claim 5 further including a support on which the spool and hair rest when mounted on the spindle.

7. Apparatus as in claim 1 wherein the dimensions of the hollow of the needle allow only a single hair to be received thereinto.

8. Apparatus for implanting hair in a scalp base comprising means for holding a bundle of hairs, a needle hollowed out at least at one end thereof, and means for moving the needle so that it contacts the hair ends and receives into the hollowed out end at least one hair, and then penetrates the scalp base to implant therein the hair carried by the needle, wherein said moving means further includes a generally upright support arm disposed to pivot about one end thereof between first and second positions, a second arm pivotally mounted on the other end of said support arm and generally perpendicular thereto for carrying the needle, and needle movement control means for enabling the second arm and needle to move generally in an arc as such support arm is pivoted from said first position a certain distance towards said second position, and for causing said second arm and the needle to move generally in a linear path as said support arm is pivoted from said certain distance to the second position.

9. Apparatus as in claim 8 wherein said needle movement control means includes a third arm carried by said support arm in a generally parallel relationship therewith, one end of said third arm being pivotally attached to said second arm at a point spaced from the point at which the second arm is mounted on the support arm, and a stop means engageable by said third arm when said support arm has pivoted from said first position a certain distance to an intermediate position between the first and second positions to cause the second arm to pivot on the support arm and move in a generally linear path as the support arm is pivoted from the intermediate position to said second position.

10. Apparatus as in claim 9 wherein said moving means further includes a reciprocating means attached to said support arm for causing said support arm to pivot between the first and second positions.

11. Apparatus as in claim 10, wherein said reciprocating means includes a rotatable drive disc, a rod connecting one edge of the disc to the support arm, and drive means for causing the disc to rotate.

12. Apparatus as in claim 11 wherein said drive means includes a clutch comprising a first friction disc rotatably driven by a power source, a shaft coupled to said rotatable drive disc, a second friction disc coupled to said shaft to cause rotation thereof when the second disc is rotated and slideable on said shaft between a noncontact position in which the second friction disc is out of frictional engagement with said first friction disc, and a contact position in which said second friction disc is in frictional engagement with said first friction disc so that said second friction disc is rotatably driven by the rotation of said first friction disc, and means coupled to said second friction disc for moving the second disc between said noncontact and contact positions.

13. Apparatus as in claim 12 wherein said clutch further comprises disengagement means for selectively causing the second friction disc to disengage from the first friction disc when said support arm returns to said first position.

14. Apparatus as in claim 13 wherein said disc moving means includes an actuator arm, and a linkage means responsive to movement of the actuator arm from an idle position to an operate position for causing said second friction disc to move and engage said first friction disc.

15. Apparatus as in claim 14 wherein said disengagement means comprises a cam coupled to rotate with said second friction disc, said cam having a lobe at one location on the perimeter thereof, and a contact member mounte on said linkage means controllably engageable by the lobe of said cam to cause the linkage means to contact and disengage the second friction disc from the first friction disc.

16. Apparatus as in claim 15 wherein the lobe of said cam is arranged to engage said contact member when the linkage means is expanded and the actuator arm is in the idle position.

17. Apparatus as in claim 1 further including a shoe positioned at the end of the path traversed by the needle as it moves to the second position, for supporting the scalp base into which hair is to be implanted.

18. Apparatus as in claim 17 wherein said shoe includes means defining a slot into which the needle extends when the needle is moved to the second position.

19. Apparatus as in claim 17 wherein said shoe includes means defining a generally circular opening into which the needle extends when the needle is moved to the second position.

20. Apparatus as in claim 17 wherein said shoe includes a turret, a slot defining means formed on the turret, and a ring formed on the turret, said turret being rotatable to selectively position either the slot defining means or the ring so that the needle extends therethrough when moved to the second position.

21. Apparatus as in claim 1 further including light projecting means for projecting a narrow beam of light through a point at the end of the path traversed by the needle as it moves to the second position, to thereby mark the location through which the needle will pass.

22. Apparatus for implanting hair in a scalp base comprising a frame, a needle having a generally cylindrical hollow extending longitudinally within the shank of the needle, means mounted on the frame for moving the needle generally in an arc-like path between first and second positions, and means mounted on the frame for positioning a plurality of hairs between the first and second positions so that as the needle is moved from the first position toward the second position, it contacts the hair ends and receives into the hollow at least one hair.

23. Apparatus as in claim 22 further including a shoe element mounted on the frame for supporting the scalp base, said shoe element being positioned so that when the scalp base is placed thereon, the needle will penetrate the scalp base as the needle moves to the second position, to thereby implant a hair carried by the needle.

24. Apparatus as in claim 23 further including means mounted on the frame for projecting a beam of light to the shoe element at a location through which the needle travels.

25. Apparatus as in claim 23 wherein said hollow needle is beveled at one end thereof.

26. Apparatus as in claim 23 wherein said hair positioning means includes a spool, means for securing the hair on the exterior surface of the spool so that the hair extends beyond one end thereof, a spindle mounted on the frame on which the spool may be mounted, and means for causing the spindle to rotate to thereby cause the spool mounted thereon to rotate.

27. Apparatus as in claim 23 wherein said moving means includes means for causing the needle to move generally in an arc to contact the hair ends and then generally along a linear path as the needle is moved to the shoe element to implant the hair in the scalp base supported by the shoe element.

28. Apparatus as in claim 23 wherein said shoe element includes a turret, means integral with the turret for defining a slot, and means integral with the turret for defining a generally round opening, said turret being rotatable to position either the slot defining means for the opening defining means in the path traversed by the needle.

29. Apparatus as in claim 22 wherein said moving means includes drive means actuatable to cause said needle to move between the first and second positions, and means for deactuating the drive means so that the needle comes to rest in the first position.

* * * * *